United States Patent [19]

Heierli

[11] Patent Number: 4,490,950

[45] Date of Patent: Jan. 1, 1985

[54] FRONT WALL OF OVERFILLED ARCHED REINFORCED CONCRETE UNDERPASSES

[76] Inventor: Werner Heierli, Eichhalde 19, 8053 Zurich, Switzerland

[21] Appl. No.: 327,073

[22] Filed: Dec. 3, 1981

[30] Foreign Application Priority Data

Dec. 8, 1980 [CH] Switzerland ..... 9023/80

[51] Int. Cl.[3] ..... E04B 1/32

[52] U.S. Cl. ..... 52/87; 52/86; 52/89

[58] Field of Search ..... 52/86–89

[56] References Cited

U.S. PATENT DOCUMENTS

| | | | |
|---|---|---|---|
| 786,059 | 3/1905 | Simpson | 52/89 X |
| 820,342 | 5/1906 | Besser | 52/88 X |
| 1,278,364 | 9/1918 | Luten | 52/87 |

FOREIGN PATENT DOCUMENTS

| | | | |
|---|---|---|---|
| 603504 | 4/1960 | Italy | 52/91 |

*Primary Examiner*—Alfred C. Perham

*Attorney, Agent, or Firm*—Terry M. Gernstein

[57] ABSTRACT

The front wall of an overfilled reinforced concrete arch is built from two prefabricated reinforced concrete elements, that are connected in the center by an on-site cast joint, which transmit the vertical loads acting upon them only to the foundation of the underpass, while the horizontal loads, brought about by the earth pressure from the overfill, are transmitted only at the outer edges to the wing wall and to the arch foundation, on one hand, and on the other hand to the arch from the apex portion. In the apex portion, these forces are transmitted from the front wall to the arch by means of metal rods, that transmit only horizontal stresses.

10 Claims, 4 Drawing Figures

FRONT WALL OF OVERFILLED ARCHED REINFORCED CONCRETE UNDERPASSES

The invention deals with the front wall of overfilled reinforced concrete arches.

Usually, such arches are cut off at their end either slanting—depending on the slope inclination of the earth fill—or they are limited by a vertical reinforced concrete wall, placed in front of them, that abuts on the end of the arch. The earth pressure of the overfill of the arch acts upon this front wall.

The disadvantage of these conventional methods consists in the case of the slanting cut-off in the difficult practical design and construction of the end portions of the arch. In the case of prefabricated arches with reinforced concrete shells, the outer elements have to be chosen especially strong and they have to be partially fastened in the foundation, since these elements do not connect forming a complete arch because of the cutout in the apex portion. In the case of using conventional front walls, there exists the disadvantage in the costly procedure of casting on-site in the fact, that in the case of a solid connection with the edge of the arch, the front wall and the edge of the arch influence each other statically in an unclear manner, while in the case of a front wall not solidly joined to the arch, the horizontal earth pressures from the overfill can be transmitted to the lateral wing walls only with heavily built-up, heavy front wall constructions.

According to the invention, these disadvantages are eliminated inasmuch as the front wall is built from two prefabricated reinforced concrete elements, that are connected to each other and to the arch only in the apex portion, and namely in such a manner that the connection with the arch in the apex portion does induce only horizontal forces into the arch, whereas in the case of vertical relative movements between the center of the front wall and the arch apex there are not transmitted any stresses in a vertical direction from the arch to the front wall, and vice versa. This is achieved in that one or several metal rods in the apex portion are embedded in concrete in the arch itself as well as in the front wall. In such case, the metal rods can be firmly embedded in concrete over a determined length at their ends, thus being pinended, or they can be connected jointed at their ends with anchoring elements embedded in the on-site cast joint portion.

In the first case, an encasing tube concentrically surrounding the metal rod in the central portion of the steel rod allows the free movement in the case of vertical relative movements between arch and front wall. The central portion of the metal rod, surrounded by the encasing tube, is designed in a flexible but tensile-strength manner. In the second case, the metal rod rotates in the joints in the event of relative movements and, again, this rotation is made possible by a similar encasing tube. The diameter of the encasing tube has to be chosen in both cases to be large enough, so that the metal rod can move freely in the case of the relative displacements to be expected.

The embodiments of the invention are described in the following figures.

Not shown is the reinforcement extending from the front wall elements (see also FIG. 2) from left to right into the on-site cast joint, which, together with the on-site cast concrete, assures the tensional connection of both front wall elements.

Figure 1:
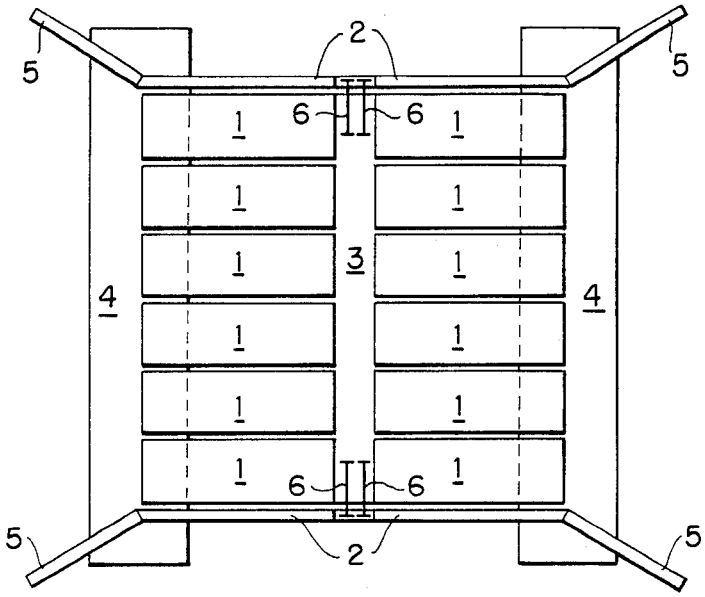
FIG. 1 shows the horizontal projection of an arch (in this example, out of prefabricated reinforced concrete shell elements).

In FIG. 1, 1 represents the reinforced concrete shell elements of the arch, 2 represents the front wall elements, 3 represents the on-site cast concrete apex joint, 4 represents the arch foundations, and 5 the wing walls. The metal rods 6 are indicated in a general manner in the apex portion at both arch ends in FIG. 1, which is represented as horizontal projection without overfill.

Figure 2:
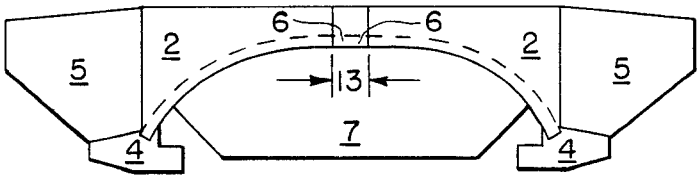
FIG. 2 shows a view of the front surface of the arch.

FIG. 2 shows a frontal view of the arch as seen from the undercrossing traffic path. 13 denotes the apex portion of the arch.

Figure 3:
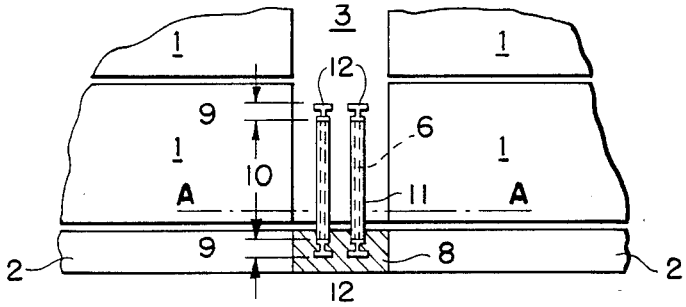
FIG. 3 shows in detail the position of the metal rods.

FIG. 3 is an enlargement of the arch horizontal projection in the apex portion at the front wall with the metal rods 6, whose end portions 9 are embedded in concrete and are thus pinended into the on-site cast concrete of the apex joint 3, on one hand, and into the on-site cast concrete of the joint 8 between the two prefabricated front wall elements, on the other hand. The central portion 10 is enclosed in an encasing tube 11.

Figure 4:
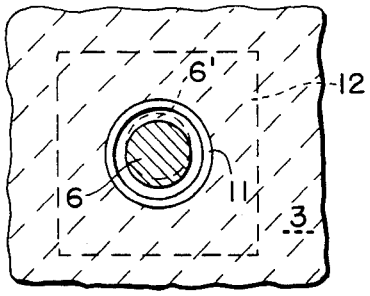
FIG. 4 shows a section taken at line A—A of FIG. 3.

FIG. 4 shows a cross section A—A vertical to the axis of the metal rod 6, wherein 6' indicates the position of the metal rod before the relative displacement. Indicated by dotted lines are the end plates 12, which induce the traction forces into the arch, resp. into the on-site cast concrete of the front wall.

I claim:

1. An overfilled reinforced concrete arch, comprising a pair of arch sections, an apex joint coupling said arch sections together at the apex of the arch, a spandrel wall which includes a pair of spandrel wall elements, a spandrel wall joint coupling said spandrel wall elements together at a location adjacent to said apex joint, and means including a tie rod embedded at one end thereof in material of said apex joint and at another end thereof in material of said spandrel wall joint for connecting said spandrel wall joint to said apex joint and further including means separating the material of said apex joint from said tie rod and extending between said embedded ends for transmitting only forces directed horizontally between said apex joint and said spandrel wall coupling joint and preventing vertically directed forces from being transmitted between the arch and said spandrel wall.

2. An overfilled nth degree curved reinforced concrete arch bridge for use in conjunction with a traffic path, the arch comprising an arch section, a spandrel wall, and connecting means connecting said spandrel wall to said arch section and transmitting only forces directed horizontally between said spandrel wall and said arch section and preventing vertically directed forces from being transmitted between said arch section and said spandrel wall.

3. The overfilled arch defined in claim 2, wherein said connecting means prevents shear forces from being transmitted between said arch section and said spandrel wall.

4. The overfilled arch defined in claim 2, wherein said connecting means prevents the formation of force couples between said arch section and said spandrel wall.

5. The overfilled arch defined in claim 2, wherein said connecting means includes a tie rod embedded at one end thereof in said arch section and at another end thereof in said spandrel wall and further includes tube means separating material of said arch from said tie rod and extending from a location spaced from and adjacent to said arch embedded tie rod end to a location adjacent to said spandrel wall embedded tie rod end.

6. The overfilled arch defined in claim 5, wherein said tube means extends to a location spaced from said spandrel wall embedded tie rod end.

7. The overfilled arch defined in claim 6, wherein said arch is elliptical in shape.

8. The overfilled arch defined in claim 5, wherein said connecting means transmits only forces directed longitudinally along said tie rod and prevents forces directed at an angle with respect to said tie rod from being transmitted between said arch section and said spandrel wall.

9. The overfilled arch defined in claim 1 or 5, wherein said tie rod is stainless steel.

10. An overfilled nth degree curved reinforced concrete arch for use in conjunction with a traffic path, the arch comprising an arch section, a spandrel wall and connecting means connecting said spandrel wall to said arch section, said spandrel wall having a face located adjacent to said arch section, said connecting means permitting said spandrel wall to move in all planar directions in a plane containing said spandrel wall face with respect to said arch section and preventing said spandrel wall from significantly moving out of such plane toward or away from said arch section.

* * * * *